US011195645B2

(12) United States Patent
Li et al.

(10) Patent No.: US 11,195,645 B2
(45) Date of Patent: Dec. 7, 2021

(54) CE-CONTAINING SINTERED RARE-EARTH PERMANENT MAGNET WITH HAVING HIGH TOUGHNESS AND HIGH COERCIVITY, AND PREPARATION METHOD THEREFOR

(71) Applicant: Central Iron and Steel Research Institute, Beijing (CN)

(72) Inventors: Anhua Li, Beijing (CN); Haibo Feng, Beijing (CN); Wei Li, Beijing (CN); Longlong Xi, Beijing (CN); Min Tan, Beijing (CN); Yang Zhao, Beijing (CN)

(73) Assignee: CENTRAL IRON AND STEEL RESEARCH INSTITUTE, Beijing (CN)

( * ) Notice: Subject to any disclaimer, the term of this patent is extended or adjusted under 35 U.S.C. 154(b) by 0 days.

(21) Appl. No.: 17/047,229

(22) PCT Filed: Apr. 4, 2019

(86) PCT No.: PCT/CN2019/081439
§ 371 (c)(1),
(2) Date: Oct. 13, 2020

(87) PCT Pub. No.: WO2020/015389
PCT Pub. Date: Jan. 23, 2020

(65) Prior Publication Data

US 2021/0233689 A1 Jul. 29, 2021

(30) Foreign Application Priority Data

Jul. 18, 2018 (CN) ..... 201810787549.8

(51) Int. Cl.
*H01F 1/055* (2006.01)
*H01F 41/02* (2006.01)
(Continued)

(52) U.S. Cl.
CPC ..... *H01F 1/0557* (2013.01); *H01F 1/0536* (2013.01); *H01F 7/02* (2013.01); *H01F 41/0266* (2013.01)

(58) Field of Classification Search
None
See application file for complete search history.

(56) References Cited

U.S. PATENT DOCUMENTS

2011/0279205 A1* 11/2011 Fukui ..... C22C 38/005 335/302
2013/0154778 A1* 6/2013 Zhu ..... H01F 41/0266 335/302
2018/0182518 A1* 6/2018 Satoh ..... C22C 33/02

FOREIGN PATENT DOCUMENTS

CN 101694797 A 4/2010
CN 102436892 A 5/2012
(Continued)

*Primary Examiner* — Xiaowei Su
(74) *Attorney, Agent, or Firm* — Muncy, Geissler, Olds & Lowe, P.C.

(57) ABSTRACT

The present invention relates to a Ce-containing sintered rare earth permanent magnet with high toughness and high coercivity and a method of preparing the magnet, belonging to the technical field of rare earth permanent magnetic materials. The magnet is prepared by steps of raw material batching, strip casting, hydrogen decrepitation and jet milling, powder orientating and forming, sintering and heat treatment. The materials of the permanent magnet comprise the main phase alloy powders and the Ce added phase alloy powders, wherein the Ce added phase alloy is a magnetic phase or a non-magnetic liquid-phase alloy; and the Ce added phase alloy accounts for 5% to 30% of the total weight of the permanent magnet, and the remainder is the main phase alloy. During the jet milling stage, a certain concentration of oxygen is added into the inert gas, so that the final magnet has an oxygen content of 1500 to 2500 ppm.
(Continued)

The Ce-containing dual-alloy magnet prepared in accordance with the present invention has high coercivity, and the intrinsic coercivity ($H_{cj}$) is up to 17 to 28.73 kOe. The magnet of the present invention has good fracture toughness which is increased by 10% to 30% as compared with the conventional Nd—Fe—B sintered magnet. The magnet of the present invention can meet needs of high-end applications such as wind power generation, new energy vehicles, and the like, and greatly expands the application fields of Ce-containing magnets.

10 Claims, 1 Drawing Sheet

(51) Int. Cl.
*H01F 7/02* (2006.01)
*H01F 1/053* (2006.01)

(56) References Cited

FOREIGN PATENT DOCUMENTS

| | | | |
|---|---|---|---|
| CN | 102800454 | A | 11/2012 |
| CN | 104575920 | A | 4/2015 |
| CN | 104900360 | A | 9/2015 |
| CN | 106128674 | A | 11/2016 |
| CN | 107275026 | A | 10/2017 |
| CN | 108922710 | A | 11/2018 |

* cited by examiner

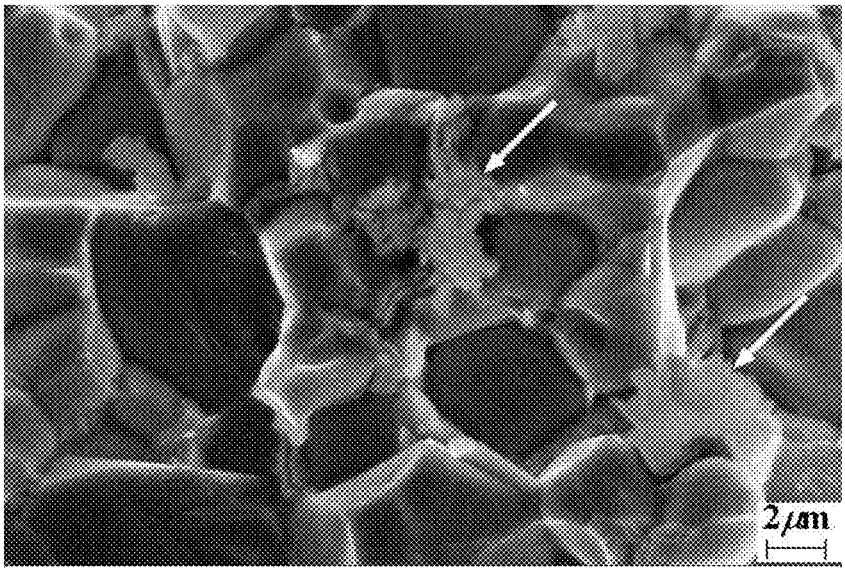
2μm

CE-CONTAINING SINTERED RARE-EARTH PERMANENT MAGNET WITH HAVING HIGH TOUGHNESS AND HIGH COERCIVITY, AND PREPARATION METHOD THEREFOR

TECHNICAL FIELD

The present invention belongs to the technical field of rare earth permanent magnetic materials, especially to a Ce-containing sintered rare earth permanent magnet with high toughness and high coercivity and a preparation method therefor.

BACKGROUND ART

With the success of large-scale production of a new generation of high-abundance cerium magnet, the high-abundance rare earth permanent magnets fabricated with Ce substitution for Nd can not only substantially reduce the raw material cost of the rare earth permanent magnets, but also be of great strategic significance to alleviate the increasingly prominent problems of serious waste of rare earth resources and environmental pollution in China, and to achieve efficient and balanced utilization of rare earth resources.

It is well known that the anisotropy field $H_A$ of $Ce_2Fe_{14}B$ compound is much lower than that of $Nd_2Fe_{14}B$, so that a Ce-containing magnet has lower coercivity in general. The literatures of [Journal of Applied Physics, 1985, 57: 4146] and [Journal of Applied Physics, 1994, 75: 6268] have reported that when 5% Ce-15% Pr—Nd is used in the magnet, the intrinsic coercivity is 10.2 kOe, and the magnetic energy product is 40 MGOe; and when 40% Ce-10% Pr-50% Nd is used in the magnet, the intrinsic coercivity is 9.2 kOe and the magnetic energy product is 28.2 MGOe. To improve the coercivity of the Ce-containing magnet, technical persons skilled in the art have made unremitting efforts.

The Chinese patent application CN102436892A describes a Ce-containing sintered magnet made by means of a double main phase method, which is heavy rare earth-free, and has an intrinsic coercivity $H_{cj}$ of around 11-12 kOe. The Chinese patent application of CN102800454A describes a sintered magnet with the nomination composition of $(Ce_x,Re_{1-x})Fe_{100-a-b-c}B_bM_c$ prepared by means of double main phase method, wherein Re is one or more selected from Nd, Pr, Dy, Tb and Ho elements, and the magnet has an intrinsic coercivity $H_{cj}$ of around 12-13 kOe. The Chinese patent application CN104900360A describes a sintered Ce-based magnet with co-addition of Gd and Ce, the magnet has an intrinsic coercivity $H_{cj}$ of around 10 kOe to 12 kOe. The Chinese patent application CN104575920A produces a sintered Ce magnet by means of a single main phase method, and the magnet has an intrinsic coercivity $H_{cj}$ of around 12 kOe to 13 kOe in a narrower range of Ce content (the Ce content is between 24 to 32 wt. % of the total rare earth content); when the magnet alloy formulation includes 3 wt. % Dy, its intrinsic coercivity $H_{cj}$ achieves about 15-16 kOe. The Chinese patent application CN107275026A discloses a Ce-rich rare earth permanent magnet of which lanthanum is used in batches, the magnet has an intrinsic coercivity $H_{cj}$ of around 9.0 kOe to 12 kOe. The Chinese patent application CN101694797A (applicant is McQueen Magnetics (Tianjin) Co., Ltd.) proposes a new Nd—Fe—B magnetic material with Ce substitution for Nd in a ratio of 10~40%, and the weight percent of total rare earth (Ce+Nd) of 27%, which is used for the production of rapidly quenched Nd—Fe—B magnetic powders of bonded magnets, and the bonded magnet has an intrinsic coercivity $H_{cj}$ of about 7 kOe to 9 kOe. In short, until now, the coercivity of Ce-containing magnets is generally relatively low, which greatly limits the application fields of the Ce-containing magnets. Moreover, the mechanical properties of permanent magnets, especially the fracture toughness thereof, play an important role in their shock resistance and machinability, and thus are of great significance to the practical application of materials.

SUMMARY OF THE INVENTION

An object of the present invention is to provide a Ce-containing sintered rare earth permanent magnet with high toughness and high coercivity, and a preparation method therefor.

To achieve the aforesaid object, the present invention provides the following technical solutions.

The present invention provides a Ce-containing sintered rare earth permanent magnet with high toughness and high coercivity prepared by steps of raw material batching, strip casting, hydrogen decrepitation and jet milling, powder orientating and forming, sintering and heat treatment, and the initial materials of the permanent magnet are the powders of the main phase alloy and Ce added phase alloy, wherein the Ce added phase alloy is a magnetic phase or non-magnetic liquid-phase alloy; the Ce added phase alloy accounts for 5% to 30% of the total weight of the permanent magnet, and the remainder is the main phase alloy; the composition of the main phase alloy is expressed as $[(Nd,Pr)_{1-x1}RE_{x1}]_{29.5-32}Fe_{bal.}B_{0.9-1.05}TM_{1.0-3.0}$ by weight percent, the composition of the Ce added phase alloy is expressed as $((Nd,Pr)_{1-x-y}Re_xCe_y)_{33-60}Fe_{bal.}B_{0.15-1.05}TM_{0.5-2.0}$ by weight percent; wherein RE is one or more of Dy, Tb, Ho and Gd, Re is one or more of La, Gd and Y, TM is one or more of Co, Ga, Al, Cu, Nb and Zr, $0.05 \le x1 \le 0.28$, $0 \le x \le 0.15$, $0.3 \le y \le 0.8$; wherein:

during the jet milling stage, a certain concentration of oxygen is added into the inert gas, so that the final magnet has an oxygen content of 1500 to 2500 ppm; and the permanent magnet has a $H_{cj}$ of 17 to 28.73 kOe and a $K_{IC}$ of 4.5 to 5.0 $MPa \cdot m^{1/2}$.

The final product of the permanent magnet includes a flocculent ceria phase.

In the final product of the permanent magnet, when the Ce added phase alloy is a magnetic phase, the permanent magnet is a double magnetic main phase magnet; and when the Ce added phase alloy is a non-magnetic liquid-phase alloy, the Ce added phase alloy becomes a grain boundary phase.

The Ce-containing high coercivity sintered rare earth permanent magnet has the following magnetic properties: remanence $B_r$=11.98 to 13.35 kG, magnetic energy product $(BH)_{max}$=35.16 to 43.68 MGOe.

A method of preparing a Ce-containing sintered rare earth permanent magnet with high toughness and high coercivity includes the following steps: (1) raw material batching, (2) strip casting, (3) hydrogen decrepitation and jet milling, (4) powder orientating and forming, and (5) sintering and heat treatment.

In Step (1), the raw materials of the main phase alloy and the Ce added phase alloy are batched in accordance with $[(Nd,Pr)_{1-x1}RE_{x1}]_{29.5-32}Fe_{bal.}$—$B_{0.9-1.05}TM_{1.0-3.0}$ and $((Nd,Pr)_{1-x-y}Re_xCe_y)_{33-60}Fe_{bal.}B_{0.15-1.05}TM_{0.5-2.0}$ by weight percent, respectively, wherein: RE is one or more of Dy, Tb, Ho and Gd, Re is one or more of La, Gd and Y, TM is one or more of Co, Ga, Al, Cu, Nb and Zr, $0.05 \le x1 \le 0.28$, $0 \leq x \leq 0.15$, $0.3 \leq y \leq 0.8$; wherein the Ce added phase alloy is a magnetic phase or non-magnetic liquid-phase alloy;

in Step (2), strip casting flakes of the main phase alloy and the Ce added phase alloy are prepared, respectively;

in Step (3), the strip casting flakes of the main phase alloy and the Ce added phase alloy are mixed at a certain ratio that the strip casting flakes of the Ce added phase alloy account for 5% to 30%, and the remainder is the strip casting flakes of the main phase alloy, and the mixture is then subjected to hydrogen decrepitation and jet milling; wherein during the jet milling stage, a certain concentration of oxygen is added into the inert gas, so that the final magnet has an oxygen content of 1500 to 2500 ppm.

The method includes the following steps:

(2) strip casting: the raw materials of the main phase alloy and the Ce added phase alloy batched in Step (1) are put into a crucible of a strip casting furnace, respectively, and subjected to vacuum induction melting under the protection of argon, after the materials are sufficiently molten, the molten alloy maintained at a temperature of 1300 to 1500° C. is poured onto a water-cooled copper roller with a linear velocity of 1.0 to 3.0 m/s to prepare the strip casting flakes of the main phase alloy and the strip casting flakes of the Ce added phase alloy with an average thickness of 0.20-0.50 mm, respectively;

(3) hydrogen decrepitation and jet milling:

the strip casting flakes of the main phase alloy and the strip casting flakes of the Ce added phase alloy prepared in Step (2) or powders prepared from the strip casting flakes of the main phase alloy and the strip casting flakes of the Ce added phase alloy are mixed at a certain ratio, the mixture is then subjected to hydrogen decrepitation, dehydrogenation, jet milling to produce powders; or, the strip casting flakes of the main phase alloy and the strip casting flakes of the Ce added phase alloy prepared in Step (2) are subjected to hydrogen decrepitation and dehydrogenation, respectively, and then the dehydrogenated powders of the main phase alloy and the Ce added phase alloy are mixed at a certain ratio, and subjected to jet milling to produce powders; or, the strip casting flakes of the main phase alloy and the strip casting flakes of the Ce added phase alloy prepared in Step (2) are subjected to hydrogen decrepitation, dehydrogenation, jet milling, respectively, to produce powders of the main phase alloy and the Ce added phase alloy, and then the powders of the main phase alloy and the Ce added phase alloy are mixed at a certain ratio;

wherein, during the jet milling stage, a certain concentration of oxygen is added into the inert gas; and the powders produced by jet milling have an average particle size of 2.0 to 5.0 μm;

(4) powder orientating and forming: the powders prepared in Step (3) are subjected to orienting and forming in a magnetic field molding press, and then subjected to cold isostatic pressing to make the green compact with a density of 3.8 to 5.0 g/cm$^3$;

(5) sintering and heat treatment: the green compact prepared in Step (4) is placed into a high-vacuum sintering furnace, vacuumized to a pressure below $10^{-1}$ Pa, then heated up; subjected to heat preservation at 400° C., 650° C. and 830 to 880° C. for 0.5 to 1 hours for degassing, respectively, sintering at 1020 to 1100° C. under vacuum for 2 to 5 hour, and then to a heat treatment at 800 to 920° C. and 400 to 650° C. for 2 to 5 hours, respectively, a Ce-containing sintered rare earth permanent magnet with high coercivity is finally obtained.

In Step (2), the linear velocity of the water-cooled copper roller is 1.0 to 2.0 m/s, and strip casting flakes with an average thickness of 0.28 to 0.32 mm is prepared.

In Step (3), during the jet milling stage, the concentration of oxygen added into the inert gas is 50 to 80 ppm.

In Step (3), the powders prepared by jet milling have an average particle size of 2.5 to 3.5 μm.

In Step (5), the sintering temperature is 1050 to 1080° C.

The final magnet has an oxygen content of 1500 to 2500 ppm, and has the following magnetic properties: the remanence $B_r$=11.98 to 13.35 kG, the magnetic energy product $(BH)_{max}$=35.16 to 43.68 MGOe, the intrinsic coercivity $H_{cj}$=17 to 28.73 kOe, the fracture toughness $K_{IC}$=4.5 to 5.0 MPa·m$^{1/2}$.

The final magnet includes a flocculent ceria phase.

Compared with the Prior Art, the Beneficial Effects of the Present Invention are as Follows The present invention of the Ce-containing sintered rare earth permanent magnet with high toughness and high coercivity includes a main phase and a Ce added phase, wherein the Ce added phase can be either a magnetic phase or a non-magnetic liquid phase. The Ce added phase alloy of the present invention has higher total rare earth content and lower melting point, which can optimize the grain boundary microstructures of the main phase, and the amount of Ce entered into the main phase is seldom. During the jet milling stage of preparing the magnet in the present invention, a certain concentration of oxygen is added into the inert gas milling medium, so that the oxygen content of the final magnet reaches 1500~2500 ppm, and a flocculent ceria phase is formed in the magnet, which plays the role of strengthening and toughening the magnet. The Ce-containing sintered permanent magnet prepared in the present invention has high toughness and high coercivity, and the intrinsic coercivity $H_{cj}$ is up 17-28.73 kOe, and the fracture toughness $K_{IC}$ is increased by 10%-30% as compared with the conventional sintered Nd—Fe—B magnet. The magnet of the present invention can be applied to high-end fields such as wind power generation and new energy vehicles, which greatly broadens the application fields of Ce-containing magnets.

BRIEF DESCRIPTION OF THE DRAWINGS

The sole FIGURE is a scanning electron microscopy (SEM) image of the Ce-containing sintered rare earth permanent magnet with high toughness and high coercivity of the present invention.

wherein the arrows refer to the flocculent ceria phases.

DETAILED DESCRIPTION OF THE EMBODIMENTS

Hereinafter, the present invention is further described by reference to the accompanying FIGURE and the examples.

The Ce-containing sintered rare earth permanent magnet with high toughness and high coercivity of the present invention is prepared by steps of raw material batching, strip casting, hydrogen decrepitation and jet milling, powder orientating and forming, sintering and heat treatment, and the initial materials of the permanent magnet include the powders of the main phase alloy and the powders of Ce added phase alloy, wherein the Ce added phase alloy is a magnetic phase or a non-magnetic liquid-phase alloy; the main phase alloy includes 70% to 95% of the total weight of the permanent magnet, and the Ce added phase alloy accounts for 5% to 30% of the total weight of the permanent magnet; the composition of the main phase alloy is expressed as $[(Nd,Pr)_{1-x1}RE_{x1}]_{29.5-32}Fe_{bal.}$—$B_{0.9-1.05}TM_{1.0-3.0}$ by weight percent, and the composition of the Ce added phase alloy is expressed as $((Nd,Pr)_{1-x-y}Re_xCe_y)_{33-60}Fe_{bal.}B_{0.15-1.05}TM_{0.5-2.0}$ by weight percent, wherein: RE is one or more of Dy, Tb, Ho and Gd, Re is one or more of La, Gd and Y, TM is one or more of Co, Ga, Al, Cu, Nb and Zr, $0.05 \le x1 \le 0.28$, $0 \le x \le 0.15$, $0.3 \le y \le 0.8$; the Ce-containing dual-alloy magnet has high coercivity and has an intrinsic coercivity $H_{cj}$ of up to 17 kOe to 28.73 kOe, the magnet has good fracture toughness and has a fracture toughness $K_{IC}$ of 4.5 to 5.0 $MPa \cdot m^{1/2}$, and its fracture toughness is increased by 10% to 30% as compared with the conventional sintered NdFeB magnet.

The final product of the permanent magnet includes a flocculent ceria phase.

During the jet milling powder preparation stage, a certain concentration of oxygen is added into the inert gas, and the final magnet has an oxygen content of 1500 to 2500 ppm.

Furthermore, the Ce-containing high coercivity sintered rare earth permanent magnet has the following magnetic properties: remanence $B_r$=11.98 to 13.35 kG, magnetic energy product $(BH)_{max}$=35.16 to 43.68 MGOe.

In the final product of the permanent magnet, when the Ce added phase alloy is a magnetic phase, the permanent magnet is a dual magnetic main phase alloy; and when the Ce added phase alloy is a non-magnetic liquid-phase alloy, the Ce added phase becomes a grain boundary phase.

A method of preparing the Ce-containing sintered rare earth permanent magnet with high toughness and high coercivity of the present invention includes the following steps: (1) raw material batching, (2) strip casting, (3) hydrogen decrepitation and jet milling, (4) powder orientating and forming, and (5) sintering and heat treatment. The specific steps are as follows:

(1) Raw material batching: the raw materials of the main phase alloy and the Ce added phase alloy are batched in accordance with $[(Nd,Pr)_{1-x1}RE_{x1}]_{29.5-32}Fe_{bal.}$—$B_{0.9-1.05}TM_{1.0-3.0}$ and $((Nd,Pr)_{1-x-y}Re_xCe_y)_{33-60}Fe_{bal.}B_{0.15-1.05}TM_{0.5-2.0}$ by weight percent, respectively, wherein: RE is one or more of Dy, Tb, Ho, and Gd, Re is one or more of La, Gd, and Y, TM is one or more of Co, Ga, Al, Cu, Nb, and Zr, $0.05 \le x1 \le 0.28$, $0 \le x \le 0.15$, $0.3 \le y \le 0.8$; wherein the Ce added phase alloy is a magnetic phase or a non-magnetic liquid-phase alloy.

(2) Strip casting: the raw materials of the main phase alloy and the Ce added phase alloy batched in Step (1) are put into a crucible of a strip casting furnace, respectively, and subjected to vacuum induction melting under the protection of argon, after the raw materials are sufficiently molten, the molten alloy maintained at a temperature of 1300 to 1500° C. is poured onto a water-cooled copper roller with a linear velocity of 1.0 to 3.0 m/s to prepare strip casting flakes of the main phase alloy and strip casting flakes of the Ce added phase alloy with an average thickness of 0.20-0.50 mm, respectively.

(3) Hydrogen decrepitation and jet milling: the strip casting flakes of the main phase alloy and the strip casting flakes of the Ce added phase alloy prepared in Step (2) (or powders prepared from the strip casting flakes) are mixed at a certain ratio, the mixture is then subjected to hydrogen decrepitation, dehydrogenation, and jet milling to produce powders with an average particle size of 2.0 to 5.0 μm.

During the jet milling powder preparation stage, the concentration of oxygen added into the inert gas is 50 to 80 ppm.

(4) Powder orientating and forming: the powders prepared in Step (3) are subjected to orientating and forming in a magnetic field molding press, and then subject to cold isostatic pressing to make the green compact with a density of 3.8 to 5.0 $g/cm^3$.

(5) Sintering and heat treatment: the green compact prepared in Step (4) is put into a high-vacuum sintering furnace, vacuumized to a pressure below $10^{-1}$ Pa, then heated up, subjected to heat preservation at 400° C., 650° C. and 830 to 880° C. for 0.5 to 1 hours for degassing (namely removing the adsorbed gas, antioxidant and lubricant), respectively, sintering at 1020 to 1100° C. under vacuum for 2 to 5 hours, and then to a heat treatment at 800 to 920° C. and 400 to 650° C. for 2 to 5 hours, respectively, a Ce-containing sintered rare earth permanent magnet with high coercivity is finally obtained.

In the method of preparing the Ce-containing high coercivity permanent magnet, the mixing of the main phase alloy and the Ce added phase alloy can be performed before or after the hydrogen decrepitation, or can be performed after the jet milling.

Preferably, in Step (2), the water-cooled copper roller has a linear velocity of 1.0 to 2.0 m/s, strip casting flakes with average thickness of 0.28 to 0.32 mm are prepared.

In Step (3), during the jet milling powder preparation stage, a certain concentration of oxygen is added into the inert gas.

Preferably, in Step (3), the powders prepared by jet milling have an average particle size of 2.5 to 3.5 μm.

Preferably, in Step (5), the sintering temperature is 1050 to 1080° C.

The final magnet has an oxygen content of 1500 to 2500 ppm, and has the following magnetic properties: the remanence $B_r$=11.98 to 13.35 kG, the magnetic energy product $(BH)_{max}$=35.16 to 43.68 MGOe, the intrinsic coercivity $H_{cj}$=17 to 28.73 kOe, the fracture toughness $K_{IC}$=4.5 to 5.0 $MPa \cdot m^{1/2}$.

In the final magnet, the Ce added phase alloy is a magnetic phase or a non-magnetic liquid-phase alloy: when the content of rare earth elements is lower in the Ce added phase alloy, a magnetic phase is obtained, and the permanent magnet is a dual-main phase permanent magnet; and when the content of rare earth elements is higher in the Ce added phase alloy, the Ce added phase alloy is a non-magnetic liquid-phase alloy, which is concentrated at grain boundaries of the main phase and form the gain boundary phase. The final magnet includes a flocculent ceria phase.

EXAMPLE 1

Step 1: Raw material batching: the raw materials of the main phase alloy were batched in accordance with $(Nd,Pr)_{23.5}RE_{8.0}Fe_{bal.}B_{1.05}TM_{3.0}$ by weight percent, and the raw materials of the Ce added phase alloy were batched in accordance with $(Nd,Pr)_{23}Ce_{10}Fe_{bal.}B_{1.0}TM_{0.5}$ by weight percent, RE was one or more of Dy, Tb, and Ho; and TM was one or more of Co, Ga, Al, Cu, and Zr.

Step 2: Strip casting: The batched raw materials of the main phase alloy and the Ce added phase alloy were molten to produce strip casting flakes, respectively. First, the materials were placed into a crucible of a strip casting furnace, and subjected to vacuum induction melting under the protection of argon, after the materials were sufficiently molten, the molten alloy maintained at a temperature of 1400 to 1500° C. was poured onto a water-cooled copper roller with a linear velocity of 1.0 to 2.0 m/s to produce strip casting flakes with an average thickness of 0.28 to 0.32 mm. The strip casting flakes of the main phase alloy and the Ce added phase alloy were mixed at a ratio of 90%:10% by weight percent.

Step 3: Hydrogen decrepitation and jet milling: the strip casting flakes mixed at a certain ratio in Step 2 were subjected to hydrogen decrepitation, dehydrogenation, and jet milling to prepare powders with an average particle size of 2.5 to 3.5 μm. During the process of jet milling, a small amount of oxygen was added into the jet milling medium ($N_2$ or other inert gases), the $O_2$ concentration was 50 ppm.

Step 4: Powder orientating and forming: the powders prepared in Step 3 were subjected to orientating and forming in a magnetic field molding press, and then subjected to cold isostatic pressing to make the green compact with a density of 4.5 to 5.0 g/cm$^3$;

Step 5: Sintering and heat treatment: the green compact prepared in Step 4 was placed into a high-vacuum sintering furnace, vacuumized to a pressure below $10^{-1}$ Pa, then heated up, subjected to heat preservation at 400° C., 650° C. and 830 to 880° C. for 0.5 to 1 hours for degassing, respectively, in order to remove the adsorbed gas, antioxidant and lubricant; sintered under vacuum at 1080° C. for 2 to 5 hours, and then heat treated at 920° C. and 400 to 650° C. for 2-5 hours, respectively, a Ce-containing sintered rare earth permanent magnet with high coercivity was finally obtained, and the final magnet has an oxygen content of 1500 ppm.

The resulting magnet has magnetic properties of $B_r$=11.98 kG, $H_{cj}$=28.73 kOe, $(BH)_{max}$=35.16 MGOe; fracture toughness of $K_{IC}$=4.5 MPa·m$^{1/2}$.

EXAMPLE 2

The composition designs of the phase alloy and the Ce added phase alloy of the sintered rare earth permanent magnet of this example, and the method of preparing the sintered rare earth permanent magnet were the same as Example 1 except that the main phase alloy was mixed with the Ce added phase alloy at a ratio of 70%:30% by weight percent, the sintering temperature of the magnet was 1070° C., and the final magnet has an oxygen content of 1800 ppm.

The resulting magnet has magnetic properties of $B_r$=12.30 kG, $H_{cj}$=25.19 kOe, $(BH)_{max}$=37.06 MGOe; fracture toughness of $K_{IC}$=5.0 MPa·m$^{1/2}$.

EXAMPLE 3

Step 1: Raw material batching: the raw materials of the main phase alloy were batched in accordance with $(Nd,Pr)_{26}RE_{5.0}Fe_{bal.}B_{0.97}TM_{2.5}$ by weight percent, and the raw materials of the Ce added phase alloy were batched in accordance with $(Nd,Pr)_{12}Re_{4.5}Ce_{17}Fe_{bal.}$—$B_{1.05}TM_{2.0}$ by weight percent, RE was one or more of Dy, Tb, and Ho; Re was one or more of La, Gd, and Y; and TM was one or more of Co, Ga, Al, Cu, and Nb.

Step 2: The batched raw materials of the main phase alloy and the Ce added phase alloy were molten to produce strip casting flakes, respectively. First, the materials were placed into a crucible of a strip casting furnace, and subjected to vacuum induction melting under the protection of argon, after the materials were sufficiently molten, the molten alloy maintained at a temperature of 1400 to 1500° C. was poured onto a water-cooled copper roller with a linear velocity of 1.0 to 2.0 m/s to produce strip casting flakes with an average thickness of 0.28 to 0.32 mm. The strip casting flakes of the main phase alloy and the Ce added phase alloy were mixed at a ratio of 90%:10% by weight percent.

Step 3: Crushing and milling: the strip casting flakes mixed at a ratio in Step 2 were subjected to hydrogen decrepitation, dehydrogenation, and jet milling to obtain magnetic powders with an average particle size of 2.5 to 3.5 μm. During the process of jet milling, a small amount of $O_2$ was added into the jet milling medium ($N_2$ or other inert gases), the $O_2$ concentration was 50 ppm.

Step 4: Powder orientating and forming: the powders prepared in Step 3 were subjected to orientating and forming in a magnetic field molding press, and then subjected to cold isostatic pressing to make the green compact with a density of 4.5 to 5.0 g/cm$^3$.

Step 5: Sintering and heat treatment: the green compact prepared in Step 4 was placed into a high-vacuum sintering furnace, vacuumized to a pressure below $10^{-1}$ Pa and then heated up; subjected to heat preservation at 400° C., 650° C. and 830 to 880° C. for 0.5 to 1 hours for degassing, respectively, in order to remove the adsorbed gas, antioxidant and lubricant; sintered under vacuum at 1070° C. for 2 to 5 hours, and then heat treated at 920° C. and 400 to 650° C., respectively, a Ce-containing sintered rare earth permanent magnet with high coercivity was finally obtained, and the final magnet has an oxygen content of 1800 ppm.

The resulting magnet has magnetic properties of $B_r$=12.72 kG, $H_{cj}$=23.86 kOe, $(BH)_{max}$=39.64 MGOe; fracture toughness of $K_{IC}$=4.8 MPa·m$^{1/2}$.

EXAMPLE 4

Step 1: Raw material batching: the raw materials of the main phase alloy were batched in accordance with $(Nd,Pr)_{29}RE_{1.5}Fe_{bal.}B_{0.92}TM_{1.0}$ by weight percent, and the raw materials of the Ce added phase alloy were batched in accordance with $(Nd,Pr)_6Re_6Ce_{48}Fe_{bal.}$—$B_{0.15}TM_{1.0}$ by weight percent, RE was one or more of Dy, Tb, Ho, and Gd; Re was one or more of La, Gd, and Y; and TM was one or more of Co, Ga, Al, Cu, and Zr.

Step 2: Rapid solidification smelting: the batched raw materials of the main phase alloy and the Ce added phase alloy were molten to produce rapid solidification flakes, respectively. First, the materials were placed into a crucible of a rapid solidification furnace, and subjected to a vacuum induction melting under the protection of argon, after the materials were sufficiently molten, the molten alloy maintained at a temperature of 1400 to 1500° C. was poured onto a water-cooled copper roller with a linear velocity of 1.0 to 2.0 m/s to produce rapid solidification flakes with an average thickness of 0.28 to 0.32 mm. The rapid solidification flakes of the main phase alloy and the Ce added phase alloy were mixed at a ratio of 95%:5% by weight percent.

Step 3: Hydrogen decrepitation and jet milling: the rapid solidification flakes mixed at a certain ratio in Step 2 were subjected to hydrogen decrepitation, dehydrogenation, and jet milling to prepare powders with an average particle size of 2.5 to 3.5 μm. During the process of jet milling, a small amount of $O_2$ was added into the jet milling medium ($N_2$ or other inert gases), the $O_2$ concentration was 80 ppm.

Step 4: Powder orientating and forming: the powders prepared in Step 3 were subjected to orientating and forming in a magnetic field molding press, and then subjected to cold isostatic pressing to make the green compact with a density of 4.5 to 5.0 g/cm$^3$.

Step 5: Sintering and heat treatment: the green compact prepared in Step 4 was placed into a high-vacuum sintering furnace, vacuumized to a pressure below $10^{-1}$ Pa, and then heated up; subjected to heat preservation at 400° C., 650° C. and 830 to 880° C. for 0.5 to 1 hours for degassing, respectively, in order to remove the adsorbed gas, antioxidant and lubricant; and then sintered under vacuum at 1075° C. for 2 to 5 hours, and then heat treated at 900° C. and 400 to 650° C., a Ce-containing sintered rare earth permanent magnet with high coercivity was finally obtained, and the final magnet has an oxygen content of 2500 ppm.

The resulting magnet has magnetic properties of $B_r$=13.35 kG, $H_{cj}$=18.52 kOe, $(BH)_{max}$=43.68 MGOe; and fracture toughness of $K_{IC}$=4.85 MPa·$m^{1/2}$.

TABLE 1

Comparison of Performances of Examples of the Present Invention and High-Coercivity Nd—Fe—B Magnets

| | Remanence $B_r$/kG | Intrinsic coercivity $H_{cj}$/kOe | Magnetic energy product $(BH)_m$/MGOe | Fracture toughness $K_{IC}$/ MPa · $m^{1/2}$ |
|---|---|---|---|---|
| Example 1 | 11.98 | 28.73 | 35.16 | 4.5 |
| Example 2 | 12.30 | 25.19 | 37.06 | 5.0 |
| Example 3 | 12.72 | 23.86 | 39.64 | 4.80 |
| Example 4 | 13.35 | 18.52 | 43.68 | 4.85 |
| Comparable Example 1 (35EH magnet product) | 11.90 | 30.5 | 34.69 | 3.86 |
| Comparable Example 2 (40SH magnet product) | 12.69 | 21.17 | 39.45 | 4.05 |

The invention claimed is:

1. A Ce-containing sintered rare earth permanent magnet with high coercivity and high toughness prepared by steps of raw material batching, strip casting, hydrogen decrepitation and jet milling, powder orientating and forming, sintering and heat treatment, wherein materials of the permanent magnet comprise main phase alloy powders and Ce added phase alloy powders, the Ce added phase alloy is a magnetic phase or a non-magnetic liquid-phase alloy; the Ce added phase alloy accounts for 5% to 30% of a total weight of the permanent magnet, and the remainder is the main phase alloy; a composition of the main phase alloy is expressed as $[(Nd,Pr)_{1-x1}RE_{x1}]_{29.5-32}Fe_{bal.}B_{0.9-1.05}TM_{1.0-3.0}$ by weight percent, and the composition of the Ce added phase alloy is expressed as $((Nd,Pr)_{1-x-y}Re_xCe_y)_{33-60}Fe_{bal.}B_{0.15-1.05}TM_{0.5-2.0}$ by weight percent; wherein RE is one or more of Dy, Tb, Ho and Gd, Re is one or more of La, Gd and Y, TM is one or more of Co, Ga, Al, Cu, Nb and Zr, $0.05 \le x1 \le 0.28$, $0 \le x \le 0.15$, and $0.3 \le y \le 0.8$;

wherein during the jet milling stage, a certain concentration of oxygen is added into an inert gas, so that the final magnet has an oxygen content of 1500 to 2500 ppm;

the permanent magnet has an intrinsic coercivity $H_{cj}$ of 17 to 28.73 kOe, and a fracture toughness ($K_{IC}$) of 4.5 to 5.0 MPa·$m^{1/2}$; and wherein the Ce-containing high coercivity sintered rare earth permanent magnet has following magnetic properties: remanence ($B_r$)=11.98 to 13.35 kG, and magnetic energy product ($(BH)_{max}$)=35.16 to 43.68 MGOe.

2. The Ce-containing sintered rare earth permanent magnet with high toughness and high coercivity according to claim 1, wherein a final product of the permanent magnet contains flocculent phase of cerium oxide.

3. The Ce-containing sintered rare earth permanent magnet with high toughness and high coercivity according to claim 1, wherein in a final product of the permanent magnet, when the Ce added phase alloy is a magnetic phase alloy, the permanent magnet is a dual main phase magnet; and when the Ce added phase alloy is a non-magnetic liquid-phase alloy, the Ce added phase alloy becomes a grain boundary phase.

4. The method of preparing the Ce-containing sintered rare earth permanent magnet with high toughness and high coercivity according to claim 1, comprising the following steps: (1) raw material batching, (2) strip casting, (3) hydrogen decrepitation and jet milling, (4) powder orientating and forming, and (5) sintering and heat treatment, wherein in Step (1), raw materials of a main phase alloy and a Ce added phase alloy are batched in accordance with $[(Nd,Pr)_{1-x1}RE_{x1}]_{29.5-32}Fe_{bal.}B_{0.9-1.05}TM_{1.0-3.0}$ and $((Nd,Pr)_{1-x-y}Re_xCe_y)_{33-60}Fe_{bal.}B_{0.15-1.05}TM_{0.5-2.0}$ by weight percent, respectively, wherein RE is one or more of Dy, Tb, Ho and Gd, Re is one or more of La, Gd and Y, TM is one or more of Co, Ga, Al, Cu, Nb and Zr, $0.05 \le x1 \le 0.28$, $0 \le x \le 0.15$, $0.3 \le y \le 0.8$; wherein the Ce added phase alloy is a magnetic phase or non-magnetic liquid-phase alloy;

in Step (2), strip casting flakes of the main phase alloy and the Ce added phase alloy are prepared, respectively; and in Step (3), the strip casting flakes of the main phase alloy and the Ce added phase alloy are mixed at a certain ratio that the strip casting flakes of the Ce added phase alloy account for 5% to 30%, a remainder is the strip casting flakes of the main phase alloy, and the mixture is then subjected to hydrogen decrepitation and jet milling; wherein during the jet milling stage, a certain concentration of oxygen is added into an inert gas, so that the final magnet has an oxygen content of 1500 to 2500 ppm;

wherein the final magnet contains flocculent phase of cerium oxide.

5. The preparation method according to claim 4, comprising the following steps:

(2) strip casting: the raw materials of the main phase alloy and the Ce added phase alloy batched in Step (1) are put into a crucible of a strip casting furnace, respectively, and subjected to vacuum induction melting under protection of argon, after the raw materials are sufficiently molten, the molten alloy maintained at a temperature of 1300 to 1500° C. is poured onto a water-cooled copper roller with a linear velocity of 1.0 to 3.0 m/s to prepare the strip casting flakes of the main phase alloy and the strip casting flakes of the Ce added phase alloy with an average thickness of 0.20-0.50 mm, respectively;

(3) hydrogen decrepitation and jet milling:

the strip casting flakes of the main phase alloy and the strip casting flakes of the Ce added phase alloy prepared in Step (2) or powders prepared from the strip casting flakes of the main phase alloy and the strip casting flakes of the Ce added phase alloy are mixed at a certain ratio, the mixture is then subjected to hydrogen decrepitation, dehydrogenation, jet milling to produce powders; or, the strip casting flakes of the main phase alloy and the strip casting flakes of the Ce added phase alloy prepared in Step (2) are subjected to hydrogen decrepitation and dehydrogenation, respectively, and then the dehydrogenated powders of the main phase alloy and the Ce added phase alloy are mixed at a certain ratio, and subjected to jet milling to produce powders; or, the strip casting flakes of the main phase alloy and the strip casting flakes of the Ce added phase alloy prepared in Step (2) are subjected to hydrogen decrepitation, dehydrogenation, jet milling respectively, to produce powders of the main phase alloy and the Ce added phase alloy, and then the powders of the main phase alloy and the Ce added phase alloy are mixed at a certain ratio;

wherein, during the jet milling stage, a certain concentration of oxygen is added into the inert gas; and the powders produced by jet milling have an average particle size of 2.0 to 5.0 μm;

(4) powder orientating and forming: the powders prepared in Step (3) are subjected to orienting and forming in a magnetic field molding press, and then subjected to cold isostatic pressing to make the green compact with a density of 3.8 to 5.0 g/cm$^3$;

(5) sintering and heat treatment: the green compact prepared in Step (4) is placed into a high-vacuum sintering furnace, vacuumized to a pressure below $10^{-1}$ Pa, then heated up; subjected to heat preservation at 400° C., 650° C. and 830 to 880° C. for 0.5 to 1 hours for degassing, respectively, sintering at 1020 to 1100° C. under vacuum for 2 to 5 hours, and then to a heat treatment at 800 to 920° C. and 400 to 650° C. for 2 to 5 hours, respectively, a Ce-containing sintered rare earth permanent magnet with high coercivity is finally obtained.

6. The preparation method according to claim 5, wherein in Step (2), the linear velocity of the water-cooled copper roller is 1.0 to 2.0 m/s, and the strip casting flakes with average thickness of 0.28 to 0.32 mm are prepared.

7. The preparation method according to claim 5, wherein in Step (3), during the jet milling stage, the concentration of oxygen added into the inert gas is 50 to 80 ppm.

8. The preparation method according to claim 5, wherein in Step (3), the powders prepared by jet milling have an average particle size of 2.5 to 3.5 μm.

9. The preparation method according to claim 5, wherein in Step (5), the sintering temperature is 1050 to 1080° C.

10. The preparation method according to claim 5, wherein the final magnet has an oxygen content of 1500 to 2500 ppm, and has the following magnetic properties: the remanence $B_r$=11.98 to 13.35 kG, the magnetic energy product $(BH)_{max}$=35.16 to 43.68 MGOe, the intrinsic coercivity $H_{cj}$=17 to 28.73 kOe, the fracture toughness $K_{IC}$=4.5 to 5.0 MPa·m$^{1/2}$.

* * * * *